US012569076B2

(12) United States Patent
Belter et al.

(10) Patent No.: US 12,569,076 B2
(45) Date of Patent: Mar. 10, 2026

(54) FOLDABLE STRUCTURE FOR CHILD PLAY AREA

(71) Applicant: Melissa & Doug, LLC, Wilton, CT (US)

(72) Inventors: Rachel Belter, Montclair, VA (US); Hali Jacobucci, Monroeville, NJ (US)

(73) Assignee: Melissa & Doug, LLC, Wilton, CT (US)

( * ) Notice: Subject to any disclaimer, the term of this patent is extended or adjusted under 35 U.S.C. 154(b) by 266 days.

(21) Appl. No.: 18/235,201

(22) Filed: Aug. 17, 2023

(65) Prior Publication Data

US 2025/0057331 A1 Feb. 20, 2025

(51) Int. Cl.
*A47D 13/06* (2006.01)
*A63H 33/00* (2006.01)

(52) U.S. Cl.
CPC ..... *A47D 13/061* (2013.01); *A63H 33/006* (2013.01)

(58) Field of Classification Search
CPC .... A63H 33/003; A63H 33/006; A63H 31/08; A47D 13/061
USPC ..... 446/227; 5/417
See application file for complete search history.

(56) References Cited

U.S. PATENT DOCUMENTS 4,664,640 A * 5/1987 Shindo ..... A63H 33/006 446/229
7,302,724 B2 * 12/2007 Solomon ..... A47D 15/003 5/655
7,344,428 B2 * 3/2008 Ransil ..... A63H 33/006 446/227
10,981,077 B1 * 4/2021 Rolph ..... A47D 15/003
11,369,892 B2 6/2022 Rolph et al.
D964,478 S * 9/2022 Jiang ..... D6/300
D1,066,516 S * 3/2025 Aslan ..... D21/475
2005/0181701 A1 * 8/2005 Cheng ..... A63H 33/006 446/227
2007/0066446 A1 * 3/2007 Gelfond ..... A63B 21/4037 482/148
2009/0253342 A1 10/2009 Oren et al.
2010/0029170 A1 * 2/2010 Hall ..... A47D 15/003 446/227
2012/0083184 A1 * 4/2012 Snyder ..... A63H 33/006 446/227
2017/0172311 A1 * 6/2017 Longenecker ..... A47D 13/061
2018/0071650 A1 * 3/2018 Reese ..... A63H 33/008

FOREIGN PATENT DOCUMENTS

CN 202287342 U 7/2012
CN 203137744 U 8/2013

* cited by examiner

*Primary Examiner* — Brian E Glessner
(74) *Attorney, Agent, or Firm* — Aird & McBurney LP

(57) ABSTRACT

The present disclosure provides embodiments of a foldable stand for a child play area. The foldable stand includes a main body, a fixed leg fixedly attached to the main body, first and second movable legs movably attached to the main body by a gear mechanism and movable between an extended and a folded position. The gear mechanism includes a first gear fixedly attached to the first movable leg, and a second gear fixedly attached to the second movable leg. The first gear and the second gear mesh such that as one of the first and second movable legs is rotated in a first direction, another of the first and second movable legs rotates in a second direction. The first and second movable legs extend further horizontally from the main body than the fixed leg.

19 Claims, 13 Drawing Sheets

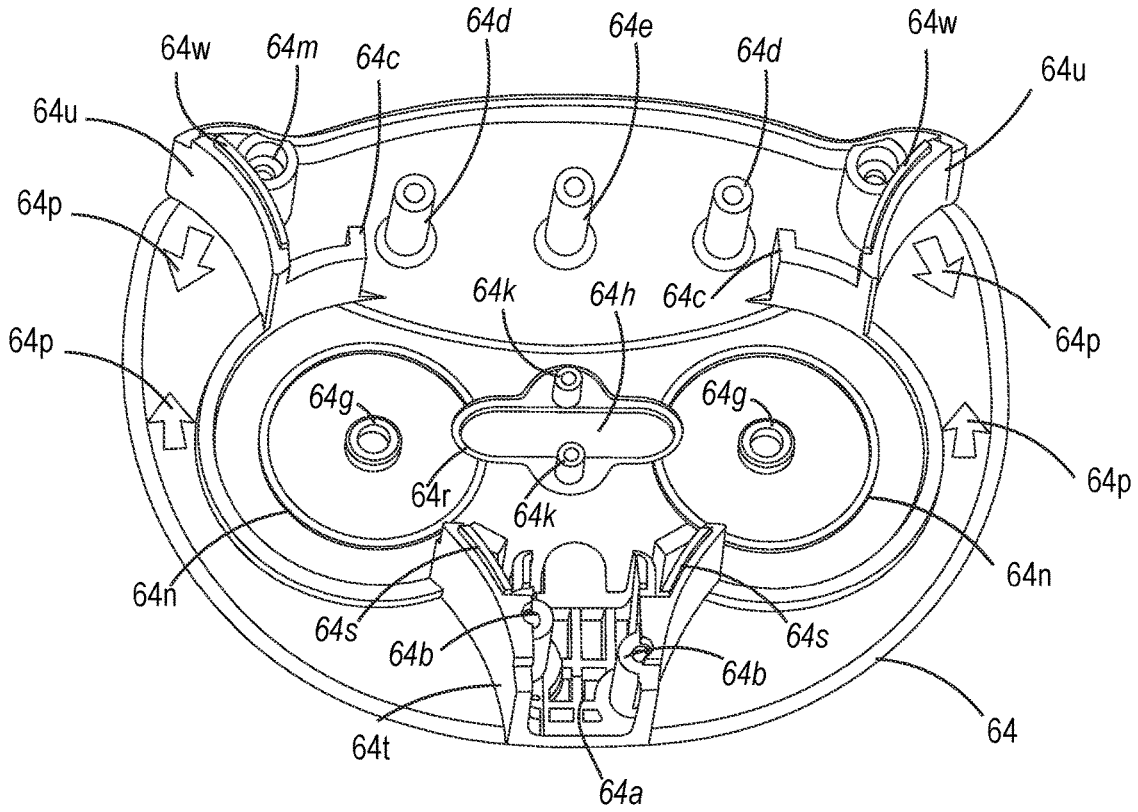
Fig. 7A
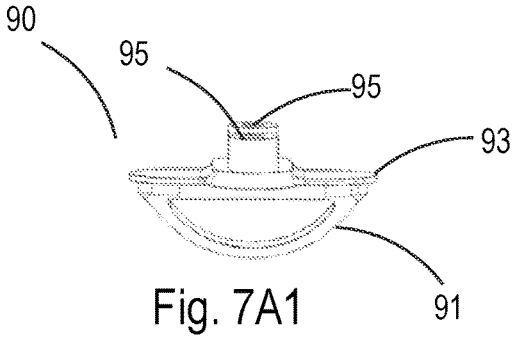
Fig. 7A1

FOLDABLE STRUCTURE FOR CHILD PLAY AREA

BACKGROUND

Field

The disclosure relates to a foldable stand and, more particularly, to a foldable stand for a child play area.

Description of the Related Art

Watching the development and growth of a child can be an amazing experience. In particular, during the early weeks and months of a child's life there is a rapid development and growth of sensory, cognitive, gross and fine motor skills. Parents and others can witness and contribute to this growth by interacting with the child and by providing items that can stimulate the child's sense of self and imagination.

Play areas are often used to provide a clean and safe environment for the child to spend time experiencing the world around them. There are various types of play areas, many of which include a blanket or cushioned mat for the child to lay down on. A stand for placing toys in the area above the play area may be provided.

A need exists for a stand that allows easy access for the child to be placed in the play area and which allows a relatively clear view of the child from all angles. The stand should be foldable between an open and closed position allowing it to be moved from one area to another and should include a locking mechanism preventing it from unintentionally folding to the open or closed positions. These are just some of the requirements for providing a safe and fun play area for the child as well as the parent or adult.

SUMMARY

The present disclosure provides embodiments of a foldable stand for a child play area. The foldable stand includes a main body, a fixed leg fixedly attached to the main body, first and second movable legs movably attached to the main body by a gear mechanism and movable between an extended and a folded position. The gear mechanism includes a first gear fixedly attached to the first movable leg, and a second gear fixedly attached to the second movable leg. The first gear and the second gear mesh such that as one of the first and second movable legs is rotated in a first direction, another of the first and second movable legs rotates in a second direction. The first and second movable legs extend further horizontally from the main body than the fixed leg.

In another exemplary embodiment a foldable stand for a child play area includes a main body having a circumference, a fixed leg fixedly attached to the main body along a portion of the circumference of the main body and first and second movable legs movably attached to the main body and movable about at least a portion of the circumference of the main body between an extended position and a folded position. The first and second movable legs extend further vertically from the main body than the fixed leg.

BRIEF DESCRIPTION OF THE DRAWINGS

The figures depict embodiments for purposes of illustration only. One skilled in the art will readily recognize from the following description that alternative embodiments of the structures illustrated herein may be employed without departing from the principles described herein, wherein:

FIG. 7A is a perspective view of a lower housing forming a portion of the foldable stand depicted in FIG. 1 according to an illustrative embodiment of the present disclosure;

FIG. 7A1 is a perspective view of a loop member attachable to the lower housing according to an illustrative embodiment of the present disclosure;

DETAILED DESCRIPTION

The present disclosure provides embodiments of child play areas. The play areas may include a foldable stand or structure, a play surface or mat and one or more child age specific toys. The foldable stand may include a fixed leg which is fixed to a main body and two movable legs which are movable with respect to the main body between an open or extended position and a closed or folded position. The positioning of the legs allows visibility to the child from all angles. The two movable legs may be interconnected by a gear assembly such that as one of the movable legs is moved, the other of the movable legs moves. The foldable stand may be arranged such that a release button is required to be pressed in order that the movable legs can be moved from the open or extended position to the closed or folded position but is not required to be pressed in order that the movable legs can be moved from the closed or folded position to the open or extended position. Possible pinch points are minimized or eliminated by providing sufficient area between the movable legs and the main body when the movable legs are in the open or extended position and the closed or folded position.

Figure 1:
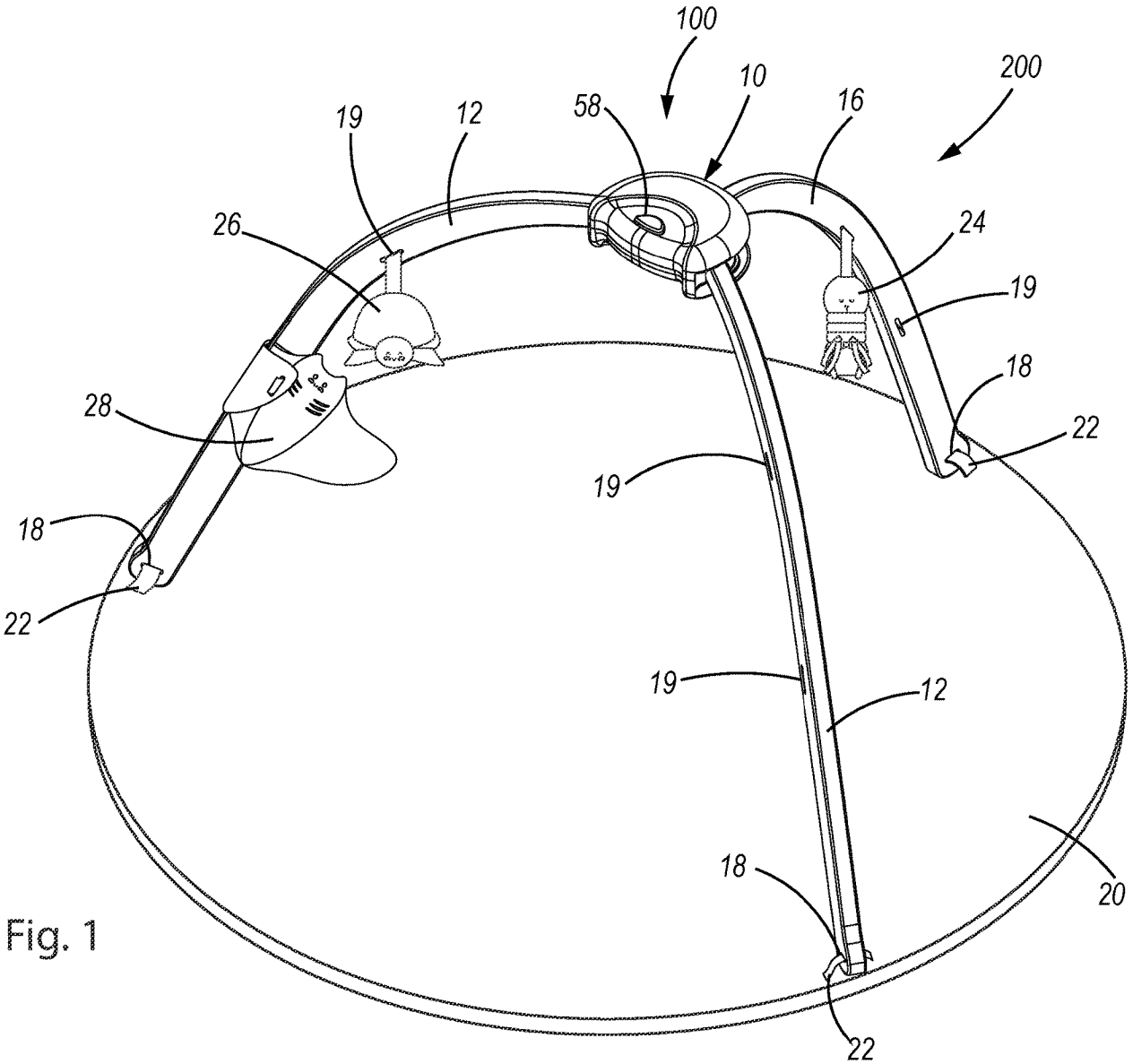
FIG. 1 is a perspective view of a child play area including a foldable stand according to an illustrative embodiment of the present disclosure.

A child play area according to an illustrative embodiment of the present disclosure is shown in FIG. 1 and is referred to herein as play area 200. Play area 200 includes a foldable stand 100, a base or mat 20 and one or more toys. Mat 20 may be a flexible material soft to a child's skin. Mat 20 may be reversable allowing the play area to grow with the child. For example, one side of mat 20 may include bold black and white images for stimulating an infant in the 0-3 month stage. The opposite side of mat 20 may include fun textural colored imaging as the baby grows and develops. The mat 20 may have features including, for example, soft animal appliques with a squeaker, crinkle paper, seaweed flaps, and ribbons for tummy time and parent engagement. The mat 20 and accessories or toys may be stuffed with 100% breathable materials that are soft for babies to lay on and play. The play area 200 is designed to stimulate a child during different milestones of the child's growth including development of sensory, cognitive, gross & fine motor skills and encourages exploration as the child grows. The play area 200 may include multiple textures & patterns for visual stimulation and toys with purposeful materials and functions.

The play area 200 may include multi-textural toys that focus on each of a child's early developmental milestones. The toys may be attached to slots 19 provided in legs 12 and 16. The toys may include a high-contrast plush turtle 26 which may be composed of different textures, a chime to create a fun melody, and a mirror for baby to discover themselves. A soft crab and octopus toy 24 may include a squeaker which helps with visual, auditory, tactile, and fine motor skills as the child grasps and squeezes the squeaker inside. Iridescent bubbles and fish toys may be provided which reflect natural light creating a soothing environment as baby plays and grows. A starfish toy can attach to the mat in designated areas to help with a child's peripheral vision, and can be moved around the mat when baby is ready for tummy time. A starfish toy may be designed to be easy to grasp, toss, and hug with different textures and crinkle to explore while child is building strength during tummy time. A manta ray kicker toy 28 may include a rattle which encourages the child to strengthen their muscles as they kick the large surface while creating a tone with the rattle inside.

Figure 2:
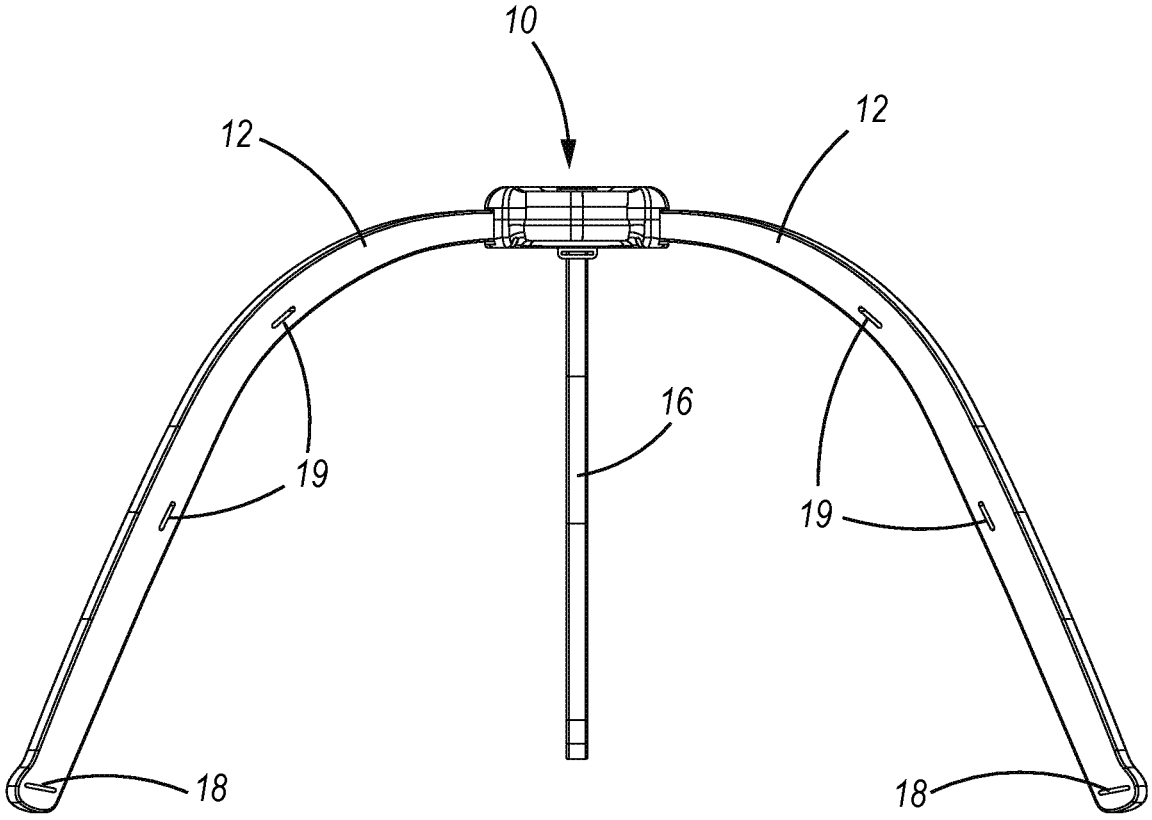
FIG. 2 is a front view of foldable stand depicted in FIG. 1 further showing the foldable stand in the open or extended position according to an illustrative embodiment of the present disclosure.
Figure 3:
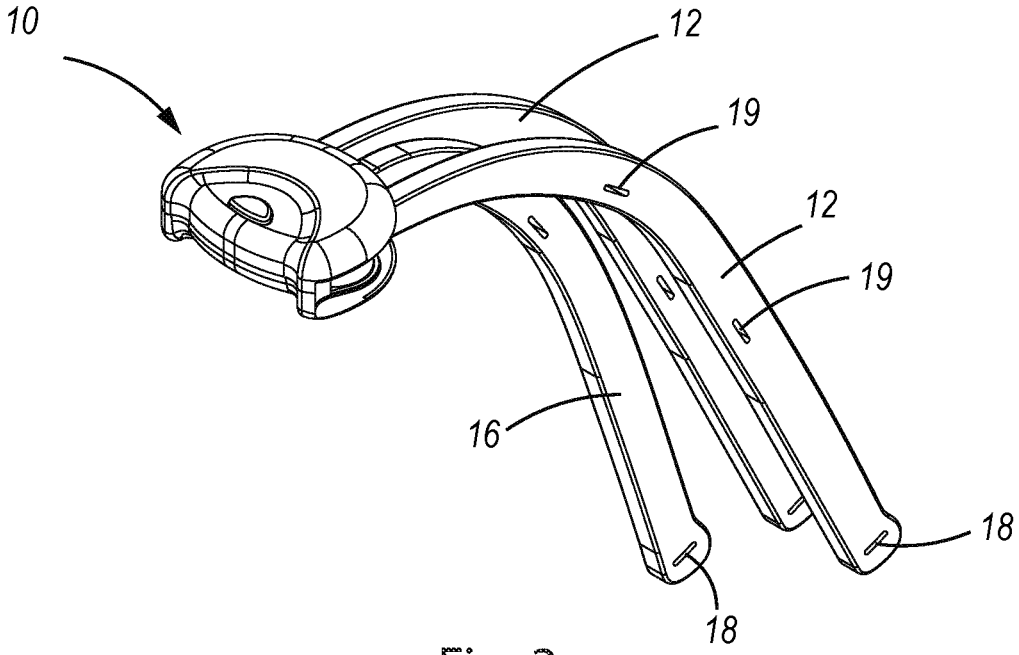
FIG. 3 is a perspective view of the foldable stand depicted in FIG. 1 further showing the foldable stand in the closed or folded position according to an illustrative embodiment of the present disclosure.

The play area 200 includes a foldable stand 100 having wide arched legs 12 and 16 extending from a main housing or body 10. Leg 16 is fixed with respect to body 10. Legs 12 are movable with respect to body 10 between the open or extended position depicted in FIGS. 1 and 2 and the closed or folded position depicted in FIG. 3. The wide arched legs 12 and 16 allow easy access to place the child in the play area and provides easy accessibility and visibility to the child from all angles. For description purposes only, movable legs 12 may be referred to as the front legs and fixed leg 16 may be referred to as the rear leg. According to an illustrative embodiment of the present disclosure, front legs 12 are preferably between approximately 15-25 inches high and more preferably between approximately 18-22 inches high and most preferably approximately 20 inches high. Front legs 12 have a horizontal extension of approximately 20 inches from their attachment point to main housing 10 and their attachment point to mat 20. In addition, according to an illustrative embodiment of the present disclosure, rear leg 16 is preferably between approximately 15-25 inches high and more preferably between approximately 16-20 inches high and most preferably approximately 18 inches high. Rear leg 16 has a horizontal extension of approximately 14 inches from its attachment point to main housing 10 and its attachment point to mat 20. According to the present illustrative embodiment, main housing 10 is preferably between approximately 15-25 inches high and more preferably between approximately 18-22 inches high and most preferably approximately 20 inches high at its highest point. The distance between the distal end portions of each of front legs 12 and rear leg 16 which attach to mat 20 is preferably between approximately 20-30 inches each and more preferably between approximately 24-26 inches each and most preferably approximately 25 inches. The angle between the rear leg 16 and each front leg 12 is more than 90 degrees and is preferably between approximately 100-135 degrees each and more preferably between approximately 110-130 degrees each and most preferably approximately 120 degrees each. Accordingly, the angle between the front legs 12 is preferably between approximately 90-160 degrees and more preferably between approximately 100-140 degrees and most preferably approximately 120 degrees. The region of mat 20 between the front legs 12 and in proximity thereto may be referred to herein as the front of the mat and the region of the mat 20 in proximity to rear leg 16 may be referred to herein as the rear of the mat 20. Main body 10 includes a locking mechanism including a release button 58 which allows an adult to easily close the front legs to the folded or closed position depicted in FIG. 3. While in the folded or closed position, the play area 200 can be easily moved from room to room or on-the-go. The foldable stand 100 may be attached to mat 20. For example, the lower portion of legs 12 and 16 have designated slots 18 for securing to straps 22 which may be attached to mat 20. The straps 22 may be formed for example from a hook-and-loop type material. This allows the foldable stand 100 to be secured to the mat 20 while the child is playing but can be easily released and removed when it is time for storage or cleaning. Alternatively, the mat 20 may be permanently attached to the bottom of the legs 12 and 16 by straps 22 which are permanently attached (e.g., glued, sewn, etc.) to the mat 20. As shown, the straps 22 connecting to the movable legs 20 do not extend radially outward from the mat 20. Instead, the straps 22 are at an angle to the radial direction. This makes it easier to fit the straps 22 into the slots 18 in the bottoms of the legs 12 and 16.

Because the front legs 12 are spaced wider than they would be if they were spaced at equal angles to one another and further because of the different lengths of the front legs 12 and rear leg 16, the bottom ends of the front legs 12 do not follow the same circular path as the edge of the mat when the stand 100 is being opened and closed. That is, the front legs 12 swing out wider than the edge of the mat 20 as they are rotated to the closed position. To accommodate for this, the straps 22 connecting the mat 20 to the front legs 12 may be provided with some slack to allow them to swing outward past the edge of the mat 20 as the legs 12 are rotated to the folded or closed position.

The foldable stand 100 includes several salient features making use of the stand 100 easy and enjoyable for the parent or adult. For example, as will be described in detail below, the foldable stand 100 includes a mechanism that allows the legs 12 to be rotated and extended outward from the closed or folded position depicted in FIG. 3 to the open or extended position depicted in FIGS. 1 and 2 without having to press the release button 58. To return the stand 100 to the closed or folded position for storage or moving, the user is required to press the release button 58 while rotating one or more of legs 12 toward fixed leg 16. A clicker mechanism may be provided that generates an audible click when the legs 12 are fully opened. As will be described in further detail below, a visual indicator may be provided indicating to the user when the legs 12 are fully in the open or extended position. When in the opened or extended position, the two movable legs 12 are spaced apart more widely than if each of the movable legs 12 were at equal angles with respect to one another. Also, the fixed leg 16 is shorter than the two movable legs 12. This arrangement provides a larger opening between front legs 12 through which an infant can easily be placed on the mat 20 and allows visibility to the child from all angles. Due to the design and the materials used to make the foldable stand 100, it is capable of withstanding a large amount (e.g., 50 pounds or more) of downward force.

Figure 4:
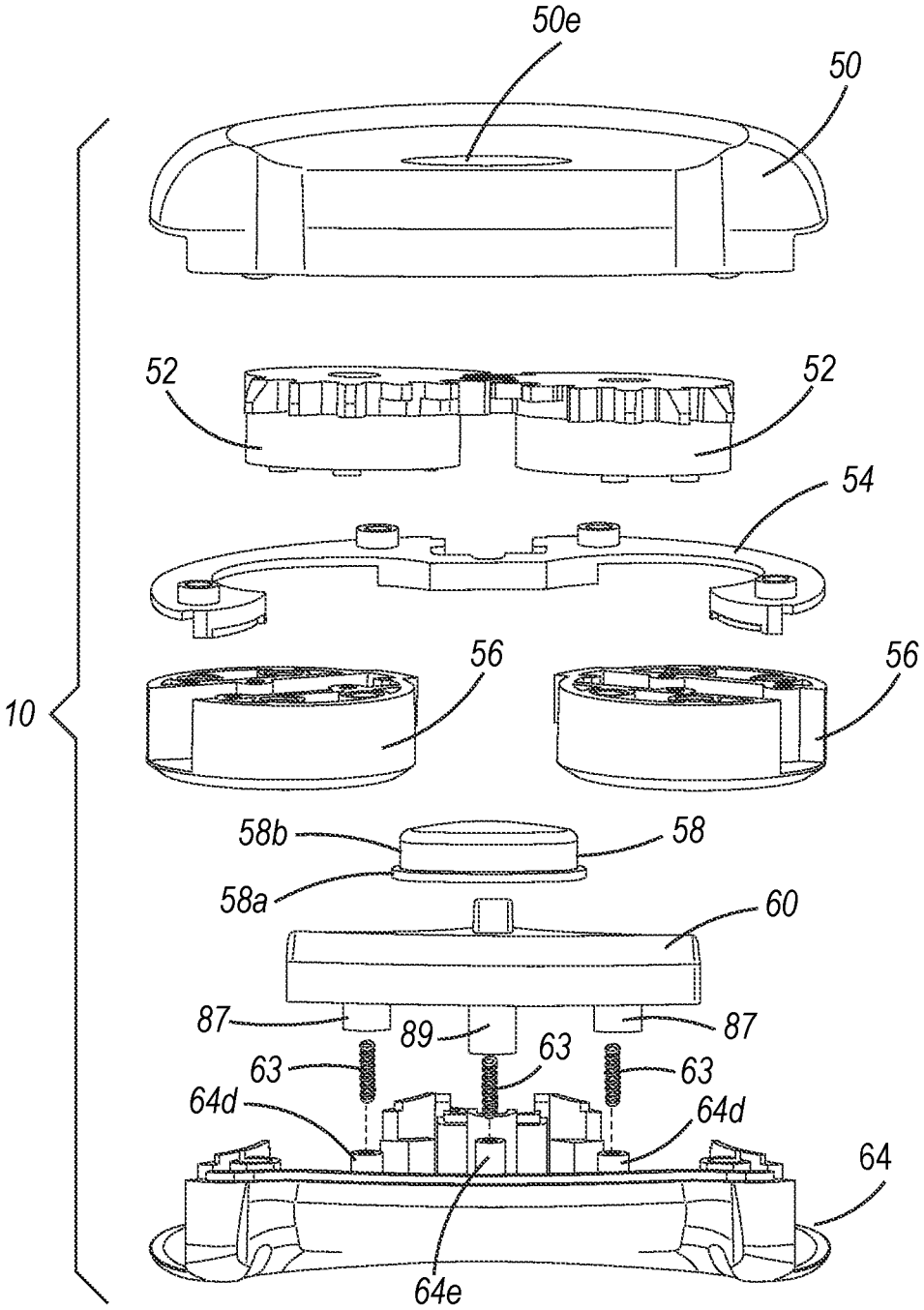
FIG. 4 is an exploded view of a portion of the foldable stand depicted in FIG. 1 according to an illustrative embodiment of the present disclosure.

An exploded view of the main body 10 of foldable stand 100 is shown in FIG. 4. Main body 10 includes cover or upper housing 50, a pair of complimentary gears 52, retainer plate 54, leg retainers 56, release button 58, detent push plate 60, one or more springs 63 and lower housing 64. Gears 52 and leg retainers 56 when attached to legs 12 combine to form leg/gear assemblies 53 which when positioned between upper housing 50 and lower housing 64 allows legs 12 to be rotated or moved between the open or extended position depicted in FIG. 1 and the closed or folded position depicted in FIG. 3.

Figure 5:
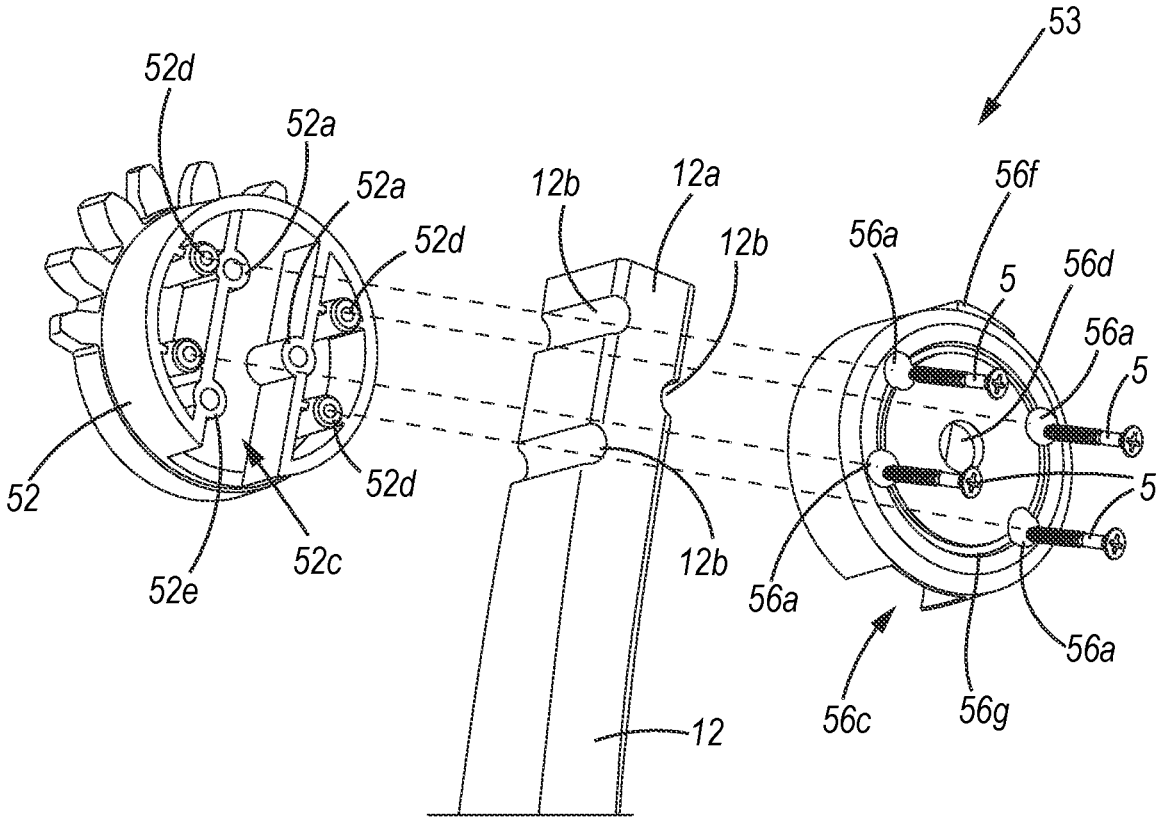
FIG. 5 is an exploded view of a leg/gear assembly forming a portion of the foldable stand depicted in FIG. 1 according to an illustrative embodiment of the present disclosure.

An exploded view of a leg/gear assembly 53 according to an illustrative embodiment of the present disclosure is depicted in FIG. 5. While two leg/gear assemblies 53 are provided, one for each of the movable legs, it will be appreciated the leg/gear assemblies 53 are essentially mirror images of each other. Accordingly, while portions of the present disclosure may be described only with respect to one of the leg/gear assemblies 53, the same description may be similarly applied to the other leg/gear assembly 53. The bottom side of gear 52 includes a rectangular slot 52*c* having one or more ridges 52*a* extending inward to rectangular slot 52*c*. Rectangular slot 52*c* is dimensioned to receive the proximal end 12*a* of movable leg 12 which has one or more grooves 12*b* positioned and dimensioned to receive the one or more ridges 52*a* extending inward to rectangular slot 52*c*. The bottom side of gear 52 also includes a plurality of standoffs with screw holes 52*d* which engage standoffs 56*e* of leg retainer 56 (e.g., see FIG. 6) for receiving screws for attaching leg retainer 56 to gear 52. Leg retainer 56 includes a rectangular slot 56*c* which corresponds to rectangular slot 52*c* in gear 52 and is also dimensioned to receive the proximal end 12*a* of movable leg 12. One or more ridges 56*b* may extend inward to rectangular slot 56*c* and are also dimensioned and positioned to be received in the grooves 12*b* provided at the proximal end 12*a* of movable leg 12 (e.g., see FIG. 6). After movable leg 12 is positioned between gear 52 and leg retainer 56, retaining screws 5 can be passed through openings 56*a* in leg retainer 56 and screwed into screw holes 52*d* in gear 52, thus securing leg/gear assembly 53 together.

Figure 6:
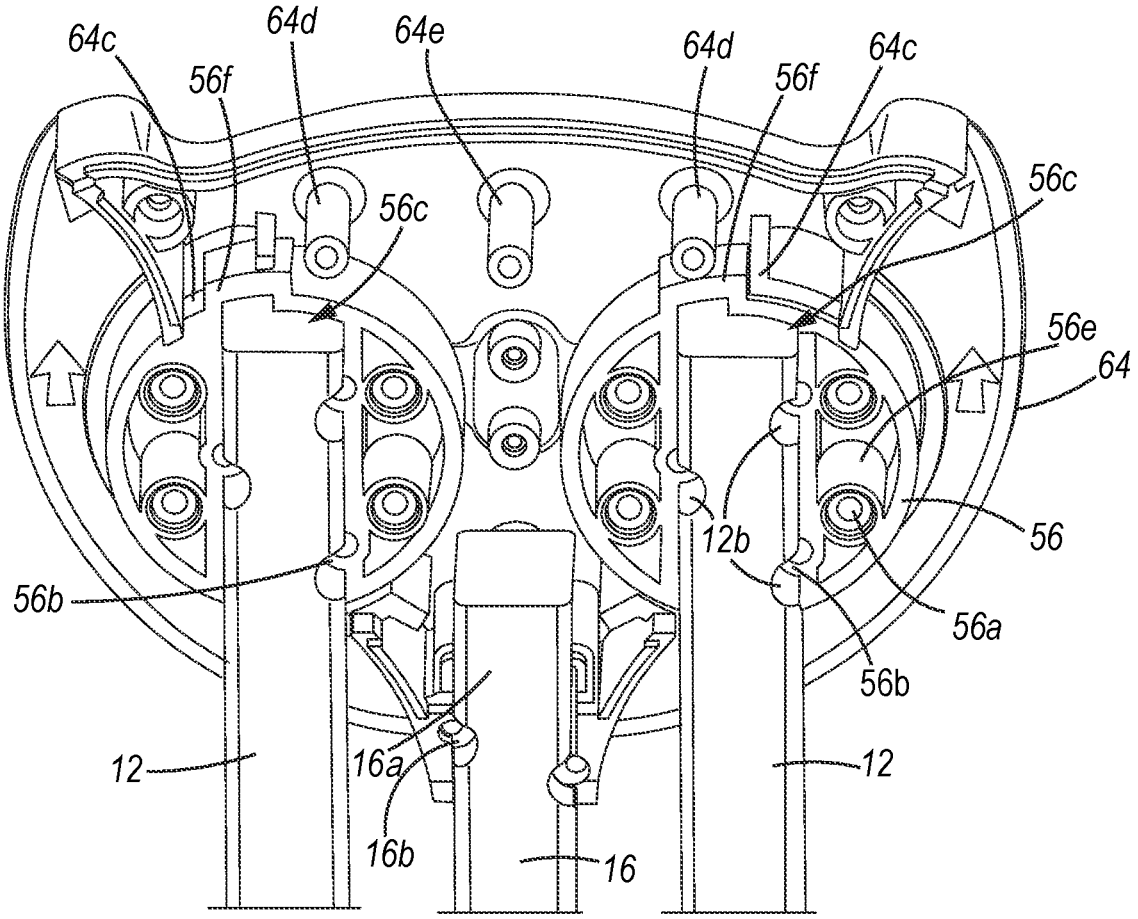
FIG. 6 is a perspective view of a lower housing forming a portion of the foldable stand depicted in FIG. 1 according to an illustrative embodiment of the present disclosure.
Figure 7B:
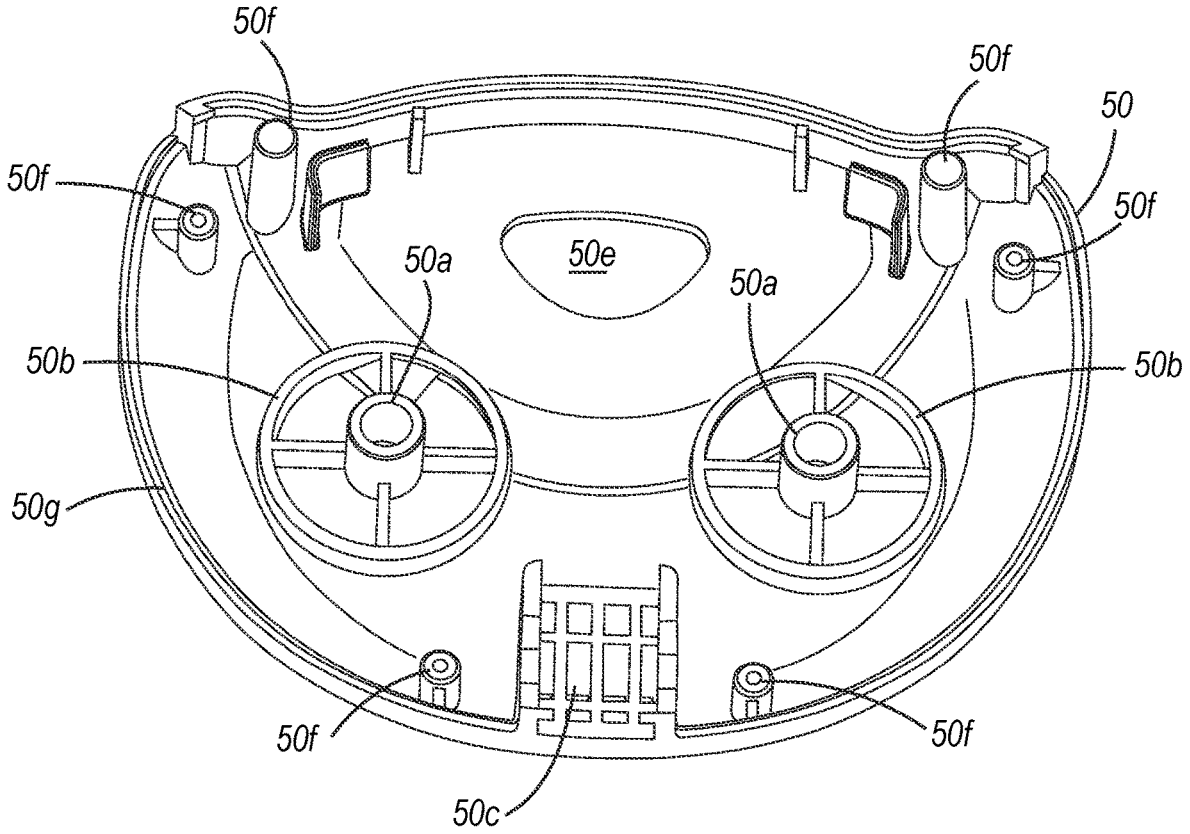
FIG. 7B is a perspective view of an upper housing forming a portion of the foldable stand depicted in FIG. 1 according to an illustrative embodiment of the present disclosure.
Figure 8:
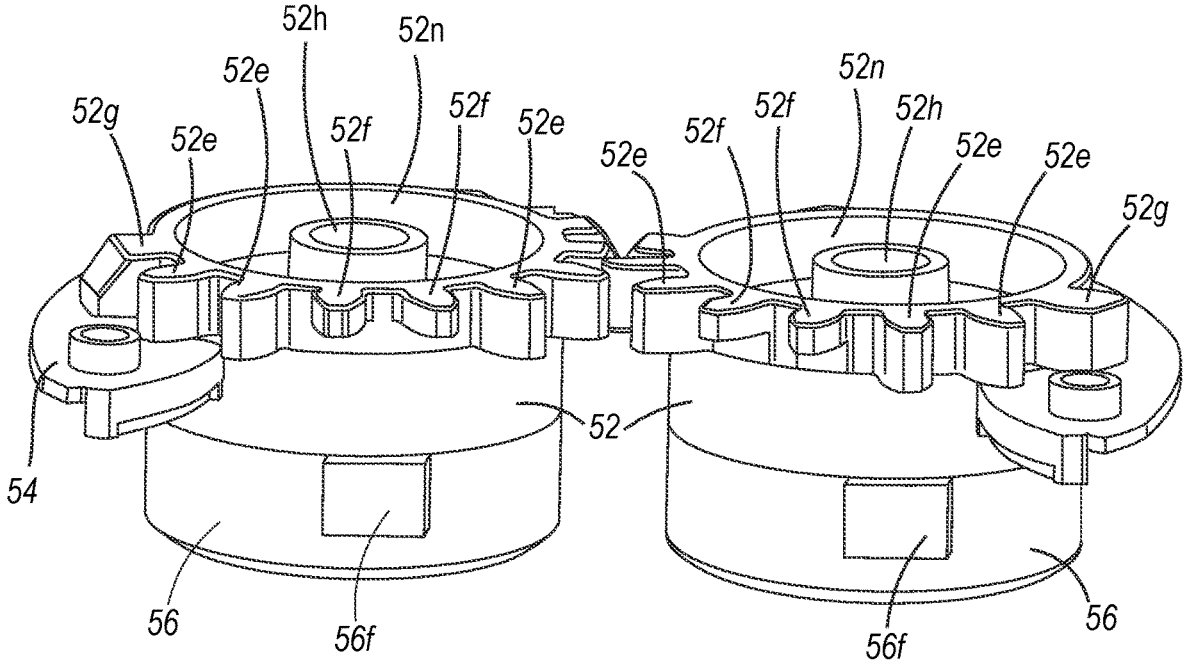
FIG. 8 is a perspective view of gears forming portions of the leg/gear assembly depicted in FIG. 5 according to an illustrative embodiment of the present disclosure.

As shown in FIG. 5, the bottom side of leg retainer 56 includes an orifice 56*d* and a circular groove 56*g* positioned and dimensioned to receive stanchion 64*g* and raised bearing surface 64*n* formed on the underside of lower housing 64 (e.g., see FIG. 7A). As shown in FIG. 8, the top side of gear 52 includes orifices or openings 52*h* and 52*n* positioned and dimensioned to receive stanchion 50*a* and raised bearing surface 50*b*, respectively, formed on upper housing 50 (e.g., see FIG. 7B). Leg/gear assembly 53 is thus rotatably mounted between upper housing 50 and lower housing 64. As shown in FIG. 6, each leg retainer 56 includes a catch 56*f* which extends outward. Each catch 56*f* is positioned and dimensioned to engage stops 64*c* extending from the lower housing 64 when movable legs 12 reach the closed or folded positions, thus preventing legs 12 from being over extended. As shown in FIG. 8, each gear 52 has a plurality of teeth including full teeth 52*e* and half teeth 52*f*. The teeth of each of the gears mesh together so that as one gear is rotated in the clockwise direction, the other gear will rotate in the counterclockwise direction and vice versa. Each gear also includes a lock tooth 52*g*.

Figure 9A:
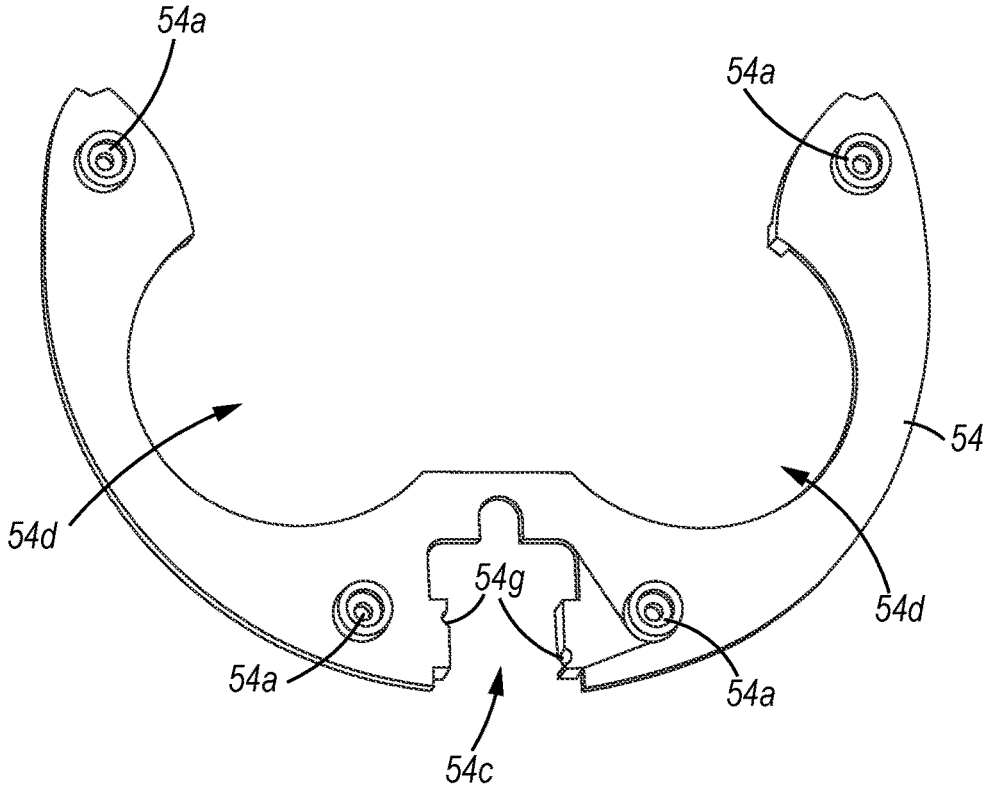
FIG. 9A is a perspective view of an upper side of a retaining plate forming a portion of the foldable stand depicted in FIG. 1 according to an illustrative embodiment of the present disclosure.
Figure 9B:
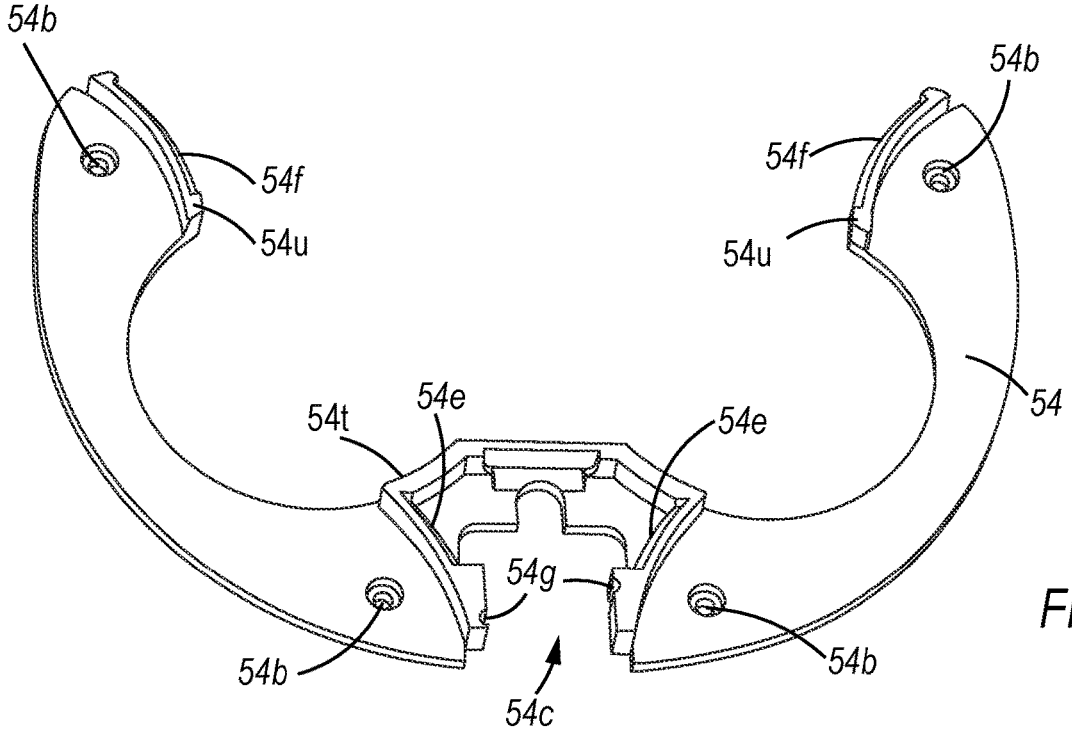
FIG. 9B is a perspective view of a lower side of the retaining plate of FIG. 9A according to an illustrative embodiment of the present disclosure.

A retainer plate 54 according to an illustrative embodiment of the present disclosure is shown in FIGS. 9A and 9B. As shown in FIG. 9A, the top side of retainer plate 54 includes a plurality of standoffs including recesses 54*a* which are positioned and dimensioned to receive stanchions 50*f* extending from the underside of upper housing 50 (see FIG. 7B). As shown in FIG. 9B. the opposite side of retainer plate 54 includes recessed screw holes 54*b* which extend through recesses 54*a* for receiving screws (not shown) for attaching retainer plate 54 to upper housing 50. At least a portion of the outer peripheral edge of upper housing 50 includes a notch 50*g* which receives the corresponding peripheral edge of retainer plate 54. While retainer plate 54 is designed to attach to upper housing 50, the bottom side of retainer plate 54 also includes features that abut or mate with features protruding from the lower housing 64. For example, raised wall 54*t* is similarly shaped to and abuts raised wall 64*t* protruding from the underside of lower housing 64 (FIG. 7A). Raised wall 54*t* includes notched portions 54*e* which receive raised lips 64*s* extending from raised wall 64*t*. In addition, raised walls 54*u* are positioned to abut raised walls 64*u* protruding from lower housing 64. Raised walls 54*u* include notched portions 54*f* which receive raised lips 64*w* extending from raised walls 64*u*. Retainer plate 54 also includes a pair of semicircular openings 54*d* positioned and dimensioned to receive gears 52.

As shown in FIG. 7A, raised wall 64*t* protruding from the underside of lower housing 64 has a rectangular slot 64*a* which includes one or more ridges 64*b* which extend inward to slot 64*a*. The bottom side of retainer plate 54 includes a corresponding rectangular slot 54*c* (FIG. 9B) and the bottom side of upper housing 50 includes a corresponding rectangular slot 50*c* (FIG. 7B). These rectangular slots 64*a*, 54*c* and 50*c* are positioned and dimensioned to receive the proximate end 16*a* of fixed rear leg 16.

Figure 10:
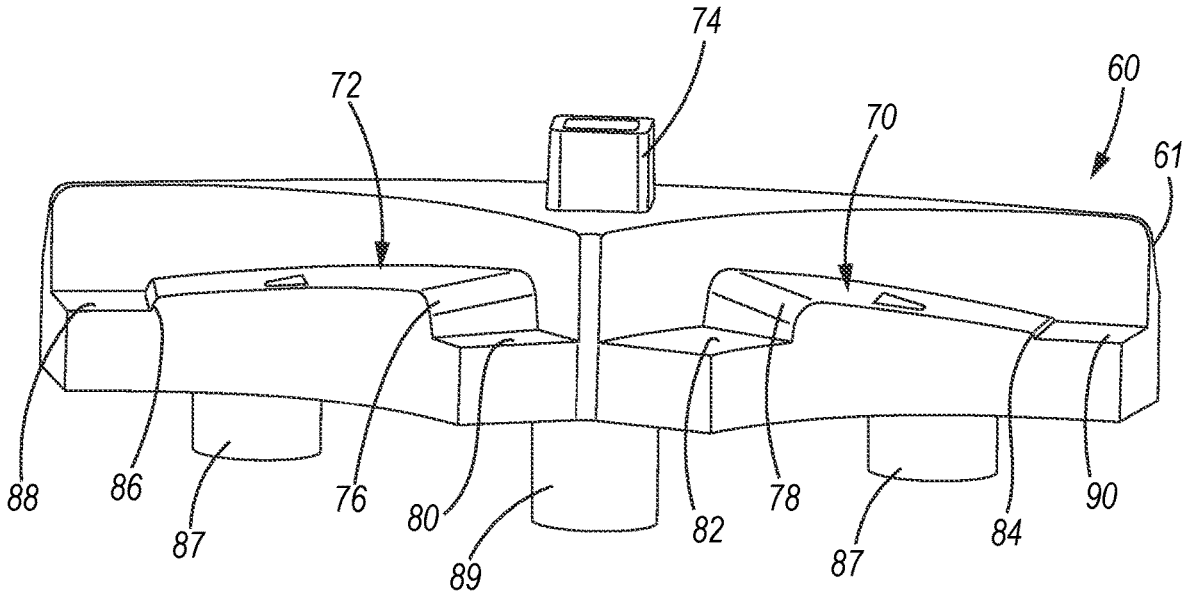
FIG. 10 is a front view of a detent push plate forming a portion of the foldable stand depicted in FIG. 1 according to an illustrative embodiment of the present disclosure.

Detent push plate 60 according to an illustrative embodiment of the present disclosure is shown in detail in FIG. 10 and includes a main body 61. Detent push plate 60 includes lower stanchions 87 and 89 having hollow bores (not shown) one or more of which receive springs 63 as well as stanchions 64*d* and 64*e* which extend upward from lower housing 64 (e.g., see FIG. 7A). The spring or springs 63 positioned inside the bores extending through stanchions 87 and 89 bias detent push plate 60 in an upward direction. Detent push plate 60 includes a button stanchion 74 extending upward therefrom which engages the bottom of release button 58. According to the present illustrative embodiment, button stanchion 74 is substantially square in cross-section. Referring to FIG. 4, release button 58 includes an upper portion 58*b* positioned and dimensioned to extend through opening 50*e* in upper housing 50 and a lower lip 58*a* positioned to contact the lower surface of upper housing 50 maintaining release button 58 in position within opening 50*e*. Release button 58 may be secured to button stanchion 74 by any desired method including glue, friction fit, weld, etc. Alternatively, the lower surface of release button 58 may include an opening (not shown) in which button stanchion 74 sits and is maintained in position by the upwards bias force of the one or more springs 63. Detent push plate 60 includes one or more detents. For example, as shown in FIG. 10, detent push plate 60 includes a small detent or step 84 between platform 90 and ramp 70. Ramp 70 extends upward from right to left to detent or step 78 which drops down to platform 82. Detent or step 78 may be rounded off as shown, providing a smooth transition to the platform 82. Detent push plate 60 may also include a small detent or step 86 between platform 88 and ramp 72. Detents or steps 84 and 86 may be the same height or may be different heights as shown. Ramp 72 extends upward from left to right to detent or step 76 which drops down to platform 80. Detent or step 76 may be rounded off as shown, providing a smooth transition to the platform 80. The heights of detents or steps 76 and 78 may be the same or different from each other. Ramps 70 and 72 have a shallow slope, ramping up at gradual angles as shown. For example, the angle of the ramps 70, 72 is generally less than 45 degrees and may be in the 10-30 degree range. The ramps 70 and 72 may have the same or similar slope or may have different slopes from each other.

According to an illustrative embodiment of the present disclosure as shown in FIG. 7A, arrows 64*p* may be provided (e.g., molded, stenciled or painted) on the inside upper surface of lower housing 64 to indicate to the user the direction the legs 12 need to rotate to the open and closed positions. Furthermore, to provide the user with confirmation that the front legs are fully extended, indicators such as colored marks (not shown) may also be provided on the inside upper surface of lower housing 64 and positioned such that they are completely covered by the front legs 12 when the legs are in the open or extended position.

Figure 12A:
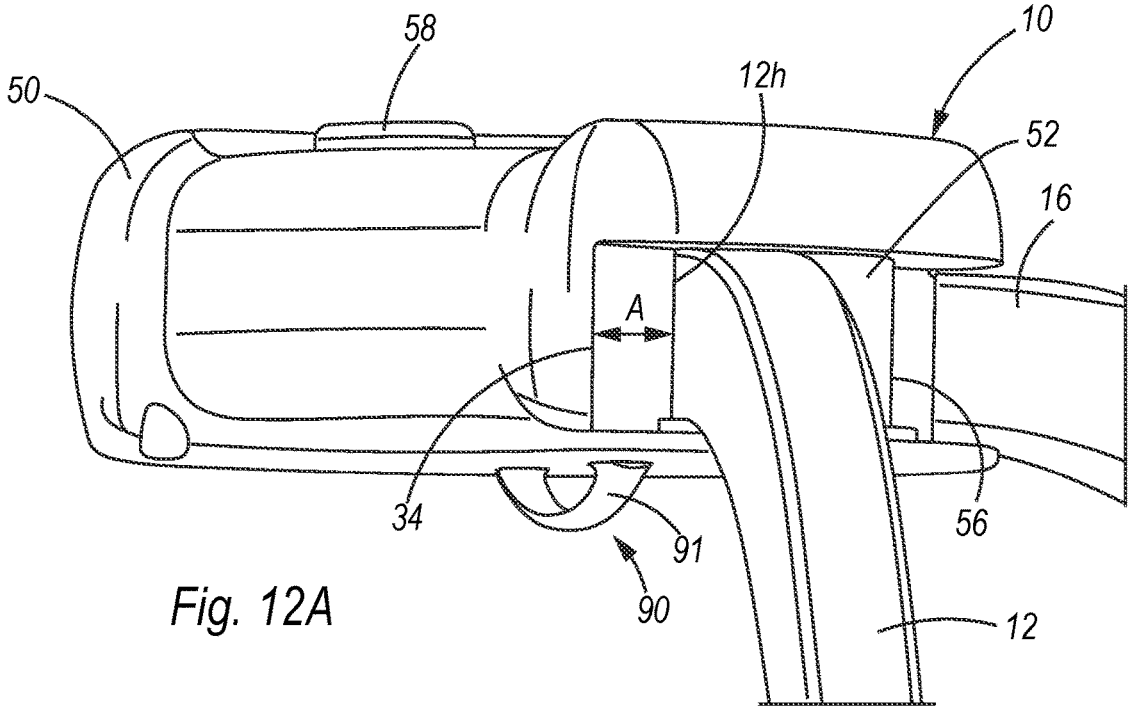
FIGS. 12A and 12B depict views of portions of the foldable stand depicted in FIG. 1 showing where and how potential pinch points are avoided according to an illustrative embodiment of the present disclosure.

A loop 90 may be provided extending from the lower side of lower housing 64 as shown in several of the figures (e.g., see FIG. 12A). Loop 90 allows one or more toys to be attached directly to the bottom portion of foldable stand 100. Loop 90 extends from loop member 91 which may be formed integral with the lower housing 64 or may be formed as a separate component attached to lower housing 64. For example, according to the present illustrative embodiment as shown in FIG. 7A1, a loop member 91 includes an oblong base 93 from which loop 90 extends down from. Oblong base 93 is inserted in and rests in the groove 64*r* provided along the periphery of oblong orifice 64*h* formed in the bottom of lower housing 64. Oblong base 93 can then be attached to lower housing 64 via screws (not shown) using screw holes 95 provided in loop member 91 and corresponding screw holes 64*k* provided in stanchions on the bottom of lower housing 64.

Figure 11A:
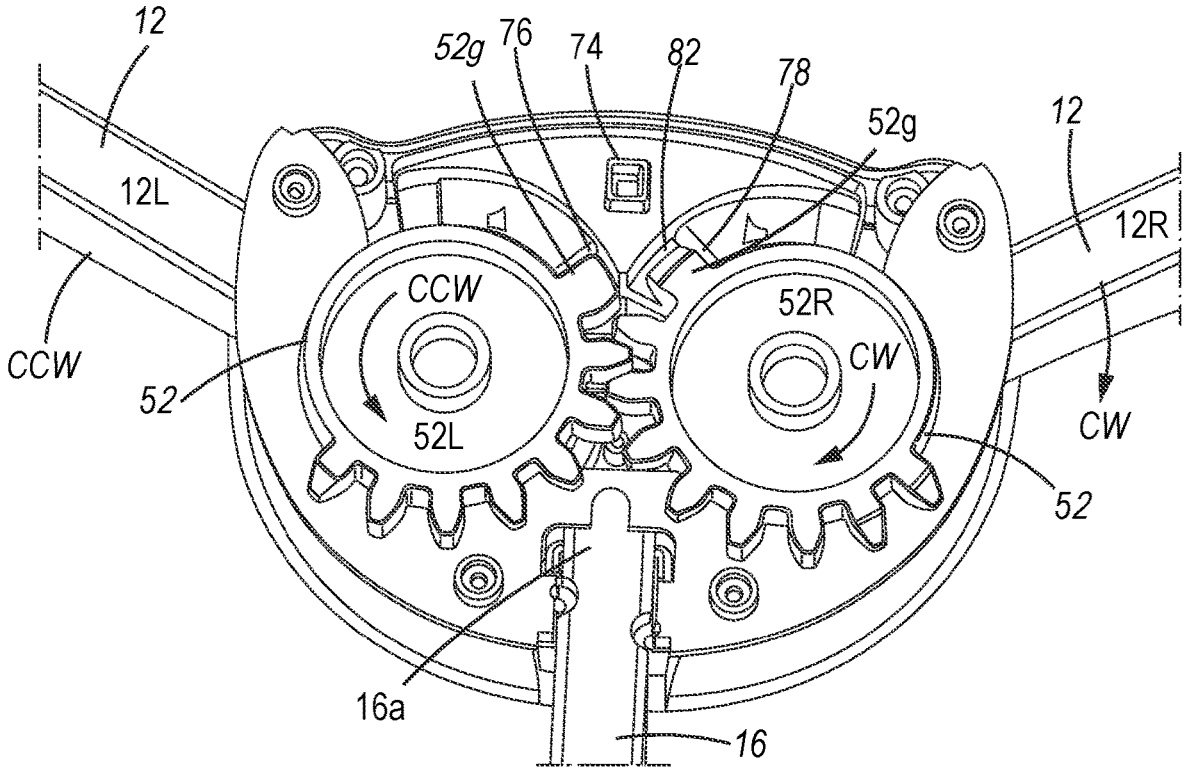
FIGS. 11A and 11B are top views of a portion of the foldable stand depicted in FIG. 1 for describing opening and closing the foldable stand according to an illustrative embodiment of the present disclosure.
Figure 11B:
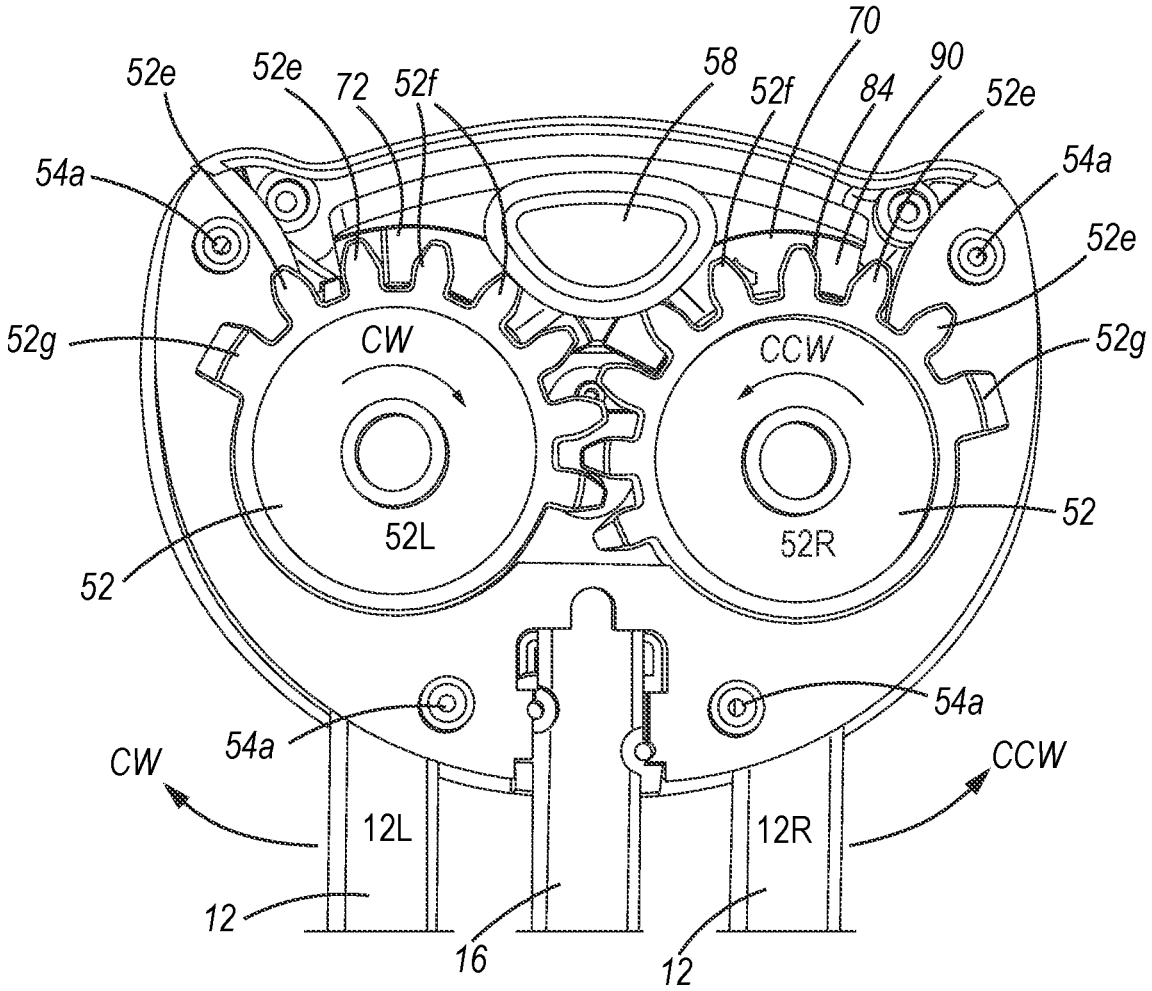

Opening and closing of foldable stand 100 will be described by reference to FIGS. 11A and 11B. As shown in FIG. 11B, when foldable stand 100 is in the closed or folded position, gears 52 are positioned so that movable legs 12 extend in the same direction parallel to fixed leg 16. In this position, half teeth 52*f* are positioned over the ramps 70, 72 of detent push plate 60. Accordingly, in this position, detent push plate 62 is biased upward by springs 63 urging release button 58 upward in the opening 50*e* in upper housing 50. In the closed or folded position depicted in FIG. 11B, movable legs 12 are free to rotate without the necessity of pressing release button 58. To open the closed or folded stand 100, one or both of legs 12 may be rotated outwardly in opposite directions. For example, as shown in FIG. 11B, right leg 12R may be moved or rotated in the counterclockwise direction which rotates gear 52R in the counterclockwise direction as indicated by arrows "CCW". Because the gears 52R and gear 52L mesh, gear 52L and leg 12L will rotate in the clockwise direction as indicated by arrows "CW". In addition or alternatively, left leg 12L may be moved or rotated in the clockwise direction which rotates gear 52L in the clockwise direction as indicated by arrows "CW". Because the gears 52R and 52L mesh, gear 52R and leg 12R will rotate in the counterclockwise direction as indicated by arrows "CCW". During this rotation, as the first full teeth 52*e* reach detents or steps 84 and 86, additional force is required to overcome these detent steps. For example, the heights of detents or steps 84 and 86 may be set to require a set amount of force to overcome these steps and each of the detents or steps 84 and 86 may be the same height or may be different heights. According to an illustrative embodiment of the present disclosure, the heights of detents or steps 84, 86 are set so that a force of about 10 lbs. is required to overcome these detents. As gears 52 continue to rotate, the full teeth 52*e* of gears 52 move up the ramps 70 and 72 urging detent push plate 60 downward against the force of the springs 63. Because of the shallow slope of ramps 70, 72, the force required to rotate gears 52 gradually increases slightly until the final teeth (lock teeth 52*g*) pass detents or steps 76, 78 and fall down and rest on platforms 80, 82 as shown in FIG. 11A. As the final teeth (lock teeth 52*g*) pass detents or steps 76, 78 and fall down to platforms 80, 82, they make an audible clicking sound indicating to the user that the legs are locked in the open or extended position. At this time, detent push plate 60 is again urged upward by the force of springs 63 urging button 58 upward in the opening 50*e* in upper housing 50. In this position, the movable legs 12 are locked in the extended or open position depicted in FIGS. 1 and 2. In this locked position, it is not readily possible for a user to rotate legs 12 such that lock teeth 52*g* can overcome detents or steps 80, 82. That is, the stand 100 cannot be easily returned to the closed or folded position without further user intervention. To return the legs 12 to the closed or folded position, the user presses release button 58 which urges detent push plate 60 downward against the force of the springs 63 allowing lock teeth 52*g* to now rotate over detents or steps 80 and 82. At this time, the user can rotate leg 12R in the clockwise direction and/or leg 12L in the counterclockwise direction to their closed or folded positions depicted in FIG. 11B.

Figure 12B:
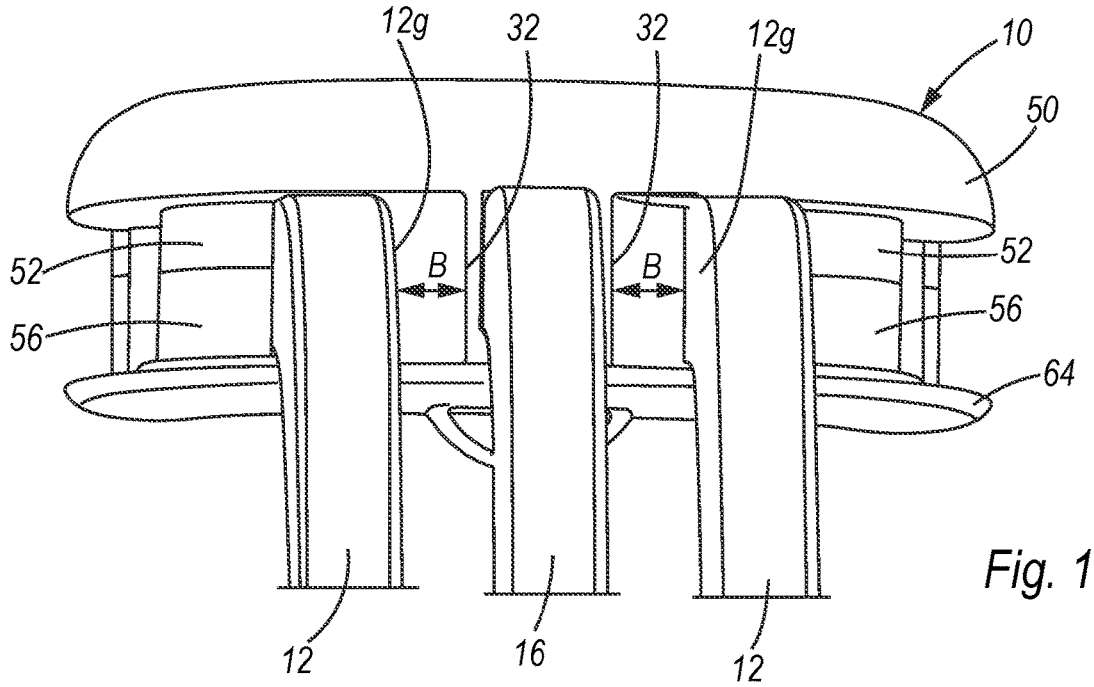

As shown in FIG. 12A, when the legs 12 are in the open or extended position, a gap "A" is provided between the edges 34 of body 10 and the adjacent sides 12*h* of legs 12. In addition, as shown in FIG. 12B, when the legs 12 are in the closed or folded position, a gap "B" is provided between the edges 32 of body 10 and the adjacent sides 12*g* of legs 12. These gaps "A" and "B" are sufficient to avoid potential pinch points as the legs 12 are moved between the open and closed positions.

The foldable stand 100 may be made from one or more various types of materials including, for example, wood, plastic, metal, etc. The foldable stand 100 may be made from the same material. Alternatively, the foldable stand 100 may be made from different materials. For example, the legs 12 and 16 may be made from a wood such as beech wood, while the components forming the main body 10 may be formed primarily from plastic.

Certain terminology may be used in the present disclosure for ease of description and understanding. Examples include the following terminology or variations thereof: top, bottom, up, upward, upper inner, outer, outward, down, downward, upper, lower, vertical, horizontal, left, right etc. These terms refer to directions in the drawings to which reference is being made and not necessarily to any actual configuration of the structure or structures in use and, as such, are not necessarily meant to be limiting.

As shown throughout the drawings, like reference numerals designate like or similar corresponding parts. While illustrative embodiments of the present disclosure have been described and illustrated above, it should be understood that these are exemplary of the disclosure and are not to be considered as limiting. Various portions of the described embodiments may be mixed and matched depending on a particular application. Additions, deletions, substitutions, and other modifications can be made without departing from the spirit or scope of the present disclosure. Accordingly, the present disclosure is not to be considered as limited by the foregoing description.

We claim:

1. A foldable structure for a child play area, the foldable structure comprising:

a main body;

a fixed leg fixedly attached to the main body; and first and second movable legs movably attached to the main body by a gear mechanism and movable between an extended and a folded position, the gear mechanism comprising;

a first gear fixedly attached to the first movable leg, and a second gear fixedly attached to the second movable leg, wherein the first gear and the second gear mesh such that as one of the first and second movable legs is rotated in a first direction, another of the first and second movable legs rotates in a second direction and wherein the first and second movable legs extend further horizontally from the main body than the fixed leg.

2. The foldable structure according to claim 1, wherein in the extended position, the first and second movable legs are each separated from the fixed leg by more than 90 degrees.

3. The foldable structure according to claim 2, wherein in the extended position, the first and second movable legs are each separated from each other by approximately 120 degrees.

4. The foldable structure according to claim 1, wherein the first and second movable legs extend further vertically from the main body than the fixed leg.

5. The foldable structure according to claim 1, further comprising a detent plate including at least one detent stop operatively associated with at least one of the first gear and the second gear.

6. The foldable structure according to claim 5, wherein the detent plate comprises two detent stops separated by a ramp and operatively associated with each of the first gear and the second gear.

7. The foldable structure according to claim 6, wherein a predetermined amount of force is required to overcome a first of the two detent stops.

8. The foldable structure according to claim 7, wherein the predetermined amount of force is approximately 10 lbs of force.

9. The foldable structure according to claim 8, wherein a second detent stop locks the movable legs in the extended position.

10. The foldable structure according to claim 5, further comprising a release button operatively associated with the detent plate.

11. The foldable structure according to claim 10, wherein when the release button is depressed, the movable legs are movable from the extended position to the folded position.

12. The foldable structure according to claim 10, wherein the movable legs are movable from the folded position to the extended position without depressing the release button.

13. A foldable structure for a child play area, the foldable structure comprising:

a main body having a circumference;

a fixed leg fixedly attached to the main body along a portion of the circumference of the main body;

first and second movable legs movably attached to the main body and movable about at least a portion of the circumference of the main body between an extended position and a folded position, wherein the first and second movable legs have distal ends that extend further from the main body than does a distal end of the fixed leg; and a first gear fixedly attached to the first movable leg and a second gear fixedly attached to the second movable leg and a detent plate including at least one detent stop operatively associated with at least one of the first gear and the second gear.

14. The foldable structure according to claim 13, wherein in the extended position, the first and second movable legs are each separated from the fixed leg by more than 90 degrees.

15. The foldable structure according to claim 14, wherein in the extended position, the first and second movable legs are each separated from each other by approximately 120 degrees.

16. The foldable structure according to claim 13, wherein the first and second movable legs extend further horizontally from the main body than the fixed leg.

17. The foldable structure according to claim 13, wherein the detent plate comprises two detent stops operatively associated with each of the first gear and the second gear.

18. The foldable structure according to claim 13, wherein a predetermined amount of force is required to overcome a first of the two detent stops.

19. The foldable structure according to claim 18, wherein a second detent stop locks the movable legs in the extended position.

* * * * *